US009771717B1

(12) United States Patent
Burnette

(10) Patent No.: US 9,771,717 B1
(45) Date of Patent: Sep. 26, 2017

(54) METAL CEILING PANEL SYSTEM WITH RETAINING CLIPS AND METHOD

(71) Applicant: Gregory Burnette, Dawsonville, GA (US)

(72) Inventor: Gregory Burnette, Dawsonville, GA (US)

( * ) Notice: Subject to any disclaimer, the term of this patent is extended or adjusted under 35 U.S.C. 154(b) by 0 days.

(21) Appl. No.: 15/194,717

(22) Filed: Jun. 28, 2016

(51) Int. Cl.
*E04B 9/22* (2006.01)
*E04B 9/06* (2006.01)
*E04B 9/10* (2006.01)
*B21D 5/14* (2006.01)

(52) U.S. Cl.
CPC ..... *E04B 9/065* (2013.01); *B21D 5/14* (2013.01); *E04B 9/064* (2013.01); *E04B 9/10* (2013.01)

(58) Field of Classification Search
CPC ..... E04F 13/0801; E04F 13/0828; E04F 13/0821; E04D 3/362; E04D 3/365; E04D 13/0477; E04B 9/10; E04B 9/065
See application file for complete search history.

(56) References Cited

U.S. PATENT DOCUMENTS

| | | | | |
|---|---|---|---|---|
| 3,324,617 | A | 6/1967 | Knight et al. | |
| 3,394,524 | A | 7/1968 | Howarth | |
| 3,417,519 | A | 12/1968 | Hitter | |
| 3,733,767 | A | 5/1973 | Craik | |
| 4,009,541 | A | 3/1977 | Yoneya | |
| 4,065,883 | A | 1/1978 | Thibodeau | |
| 4,091,588 | A | 5/1978 | Heirich | |
| 4,269,012 | A | 5/1981 | Mattingly et al. | |
| 4,522,005 | A * | 6/1985 | Seaburg | E04D 3/362 52/520 |
| 4,522,007 | A | 6/1985 | Oehlert | |
| 4,817,343 | A | 4/1989 | Rutledge | |
| 4,860,502 | A | 8/1989 | Mickelsen et al. | |
| 4,918,898 | A | 4/1990 | McLeod, Jr. | |
| 4,936,078 | A | 6/1990 | Porter | |
| 5,195,281 | A | 3/1993 | Kosko | |

(Continued)

FOREIGN PATENT DOCUMENTS

| | | | |
|---|---|---|---|
| DE | 102005005745 C5 * | 9/2011 | E04D 3/30 |
| FR | 1266994 A * | 7/1961 | E04D 3/362 |

(Continued)

OTHER PUBLICATIONS

Architectural Pricing Guide, MBCI Metal Roof & Wall Systems, Aug. 10, 2015, 79 pages (pp. 1-79 in pdf).

*Primary Examiner* — Christine T Cajilig
(74) *Attorney, Agent, or Firm* — Mitch Harris, Atty at Law, LLC; Andrew M. Harris

(57) ABSTRACT

A ceiling system for under-deck installation includes ceiling panels and retaining clips. Each ceiling panel has a first interlocking bracket and an oppositely spaced second interlocking bracket formed along the sides of the ceiling panel. The ceiling system is installed by installing a number of retaining clips along the length of the second interlocking bracket of a panel and then inserting the first interlocking bracket of the next panel in the second interlocking bracket of the first panel so that the retaining clips secure an edge of the first interlocking bracket of the next panel. Subsequent ceiling panels are connected in this manner to form the ceiling panel system.

19 Claims, 12 Drawing Sheets

(56) References Cited

U.S. PATENT DOCUMENTS

| | | | | |
|---|---|---|---|---|
| 5,201,158 | A * | 4/1993 | Bayley | E04F 13/12 52/521 |
| 5,511,351 | A | 4/1996 | Moore | |
| 5,519,974 | A | 5/1996 | Greenberg | |
| 5,584,198 | A | 12/1996 | Morello et al. | |
| 5,605,022 | A | 2/1997 | Fulton | |
| 5,673,524 | A | 10/1997 | Gailey | |
| 5,855,101 | A | 1/1999 | Schulte et al. | |
| 6,164,019 | A | 12/2000 | Salley | |
| 6,212,837 | B1 | 4/2001 | Davis et al. | |
| 6,226,941 | B1 | 5/2001 | Stevens | |
| 6,260,316 | B1 | 7/2001 | Davis et al. | |
| 6,314,698 | B1 | 11/2001 | Johansson | |
| 6,338,228 | B1 | 1/2002 | Chevalier | |
| 6,393,785 | B1 | 5/2002 | Burt | |
| 7,051,485 | B2 * | 5/2006 | Burnette | E04B 9/0478 52/506.1 |
| 8,091,312 | B2 * | 1/2012 | Simpson | E04D 3/364 52/520 |
| 9,187,911 | B2 * | 11/2015 | Bowman | E04D 13/0481 |
| 2003/0197103 | A1 * | 10/2003 | Greenberg | E04D 3/366 248/250 |

FOREIGN PATENT DOCUMENTS

| | | | | |
|---|---|---|---|---|
| GB | 817238 A | * | 7/1959 | E04D 3/362 |
| GB | 2153874 A | | 8/1985 | |

* cited by examiner

METAL CEILING PANEL SYSTEM WITH RETAINING CLIPS AND METHOD

BACKGROUND OF THE INVENTION

1. Field of the Invention

The invention relates generally to under-deck ceiling systems, and in particular to a ceiling system that includes pre-formed ceiling panels and retaining clips installed periodically for retaining an edge of the panels.

2. Background of the Invention

Panelized ceiling systems have been developed for installation under wood or composite decking, typically constructed of formed sheet metal. The use of metal sheets provides a lightweight and low cost system, while providing a high degree of weather resistance. The ceiling panels can be installed either parallel to, or perpendicular to the direction of the joists of an existing or newly-constructed deck.

The integrity of such ceiling systems is typically provided by an interlocking or overlapping edge that runs the length of the ceiling panels. However, installing such ceiling panels, which may be 10 feet in length or longer, can prove difficult due to variations in the construction of the supporting deck above, and even with near-perfect joist alignment, provides an installation difficulty for one or two installers due to the bending of the panels during installation.

Therefore, it is desirable to provide a metal ceiling panel system and installation method that are tolerant of variations in the supporting overhead structure and having an installation that is generally simplified.

SUMMARY OF THE INVENTION

The present invention includes a ceiling system, a method of constructing an under-deck ceiling system and a method of manufacture of the ceiling system.

The ceiling system includes multiple ceiling panels that have a first bracket formed along their first long side. The first bracket has a first vertical wall extending at a right angle from the top surface of the ceiling portion, a first top portion extending from the first vertical wall at a right angle and a first outwardly extending flange extending from the first top portion at a first oblique angle. A second bracket is formed along the second long side of the ceiling portion opposite the first long side. The second bracket has a second vertical wall extending at a right angle to the top surface of the ceiling portion, an inwardly extending flange extending from the second vertical wall at an acute angle, and an outwardly extending member extending from the inwardly extending flange at an opposite side of the outwardly extending member from the second vertical wall at a second oblique angle. The ceiling panel system also includes a plurality of retaining clips for installation at intervals along a length of the ceiling panels. The retaining clips include a retaining clip top portion for placement along the first top portion of the first bracket, and a retaining clip flange portion extending from the retaining clip top portion at the oblique angle for placement along the outwardly extending flange of the first bracket of a corresponding one of the plurality of ceiling panels. The retaining clips also include an inwardly extending member extending from an upper portion of the retaining clip flange portion at an acute angle forming a hook-shape, so that when a second bracket of one of the ceiling panels is fitted within a first bracket of another one of the ceiling panels to which a number of the retaining clips have been installed along the length thereof, the second bracket of the one of the ceiling panels is captured by the inwardly extending members of the number of retaining clips.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of the invention when read in conjunction with the accompanying Figures, wherein like reference numerals indicate like components, and:

DESCRIPTION OF ILLUSTRATIVE EMBODIMENT

The present disclosure is directed to a ceiling panel system having facilitated installation for under-deck installation. Under-deck ceilings, such as those made from interlocking panels, are disclosed in U.S. Pat. No. 7,051,485 by the inventor of the instant application, which is incorporated herein by reference. Such ceiling systems provide a mechanism for sequentially installing panels in the ceiling system so that the initially installed side of the second and subsequent panels are held in place while the second side is fastened to supports that suspend the panels under the deck joists. However, the mechanism disclosed in the above-referenced U.S. Patent requires the entire length of an initial side of a panel being installed to be retained by a bracket formed along a side of the previously-installed panel. When installing panels that may be 10 feet or more in length, variations in the deck construction and bending of the panels increases the difficulty in installation. The ceiling panel system disclosed herein secures the initial edge of subsequently installed panels with a set of retaining clips that are installed at intervals along the side of the previously-installed panel and at least partially in the bracket formed along that side. In the present disclosure, the bracket at the exposed side of a previously-installed panel does not include a hook-shaped retaining edge. Instead the retaining clips provide an intermittent hook edge for securing the initial edge of the subsequently installed panel, which allows compensation for variation in the deck structure and also flexure of the panels during installation.

The ceiling system disclosed herein includes individual substantially rectangular ceiling panels that have a first bracket disposed along one long side and an opposed second bracket disposed along the other long side. The ceiling panel system may also include a plurality of suspension rails that provide a distributed and controlled spacing that increases in a direction that the ceiling panels are inclined downward for drainage and a set of end channels used to cover and control the position of the ends of the ceiling panels as they are installed, as well as providing a mount for an initial side of the first panel that is installed. The ceiling panel system also includes a plurality of retaining clips that are installed at intervals along the second bracket of the panel currently being installed, so that the initial side of the next panel is held by the retaining clips as the next panel is being installed. The parts of the ceiling panels system may be sheet metal parts formed by rolling metal sheet stock through a mill having directing members for bending the sheet stock, or may be molded from a plastic material.

Figure 1A:
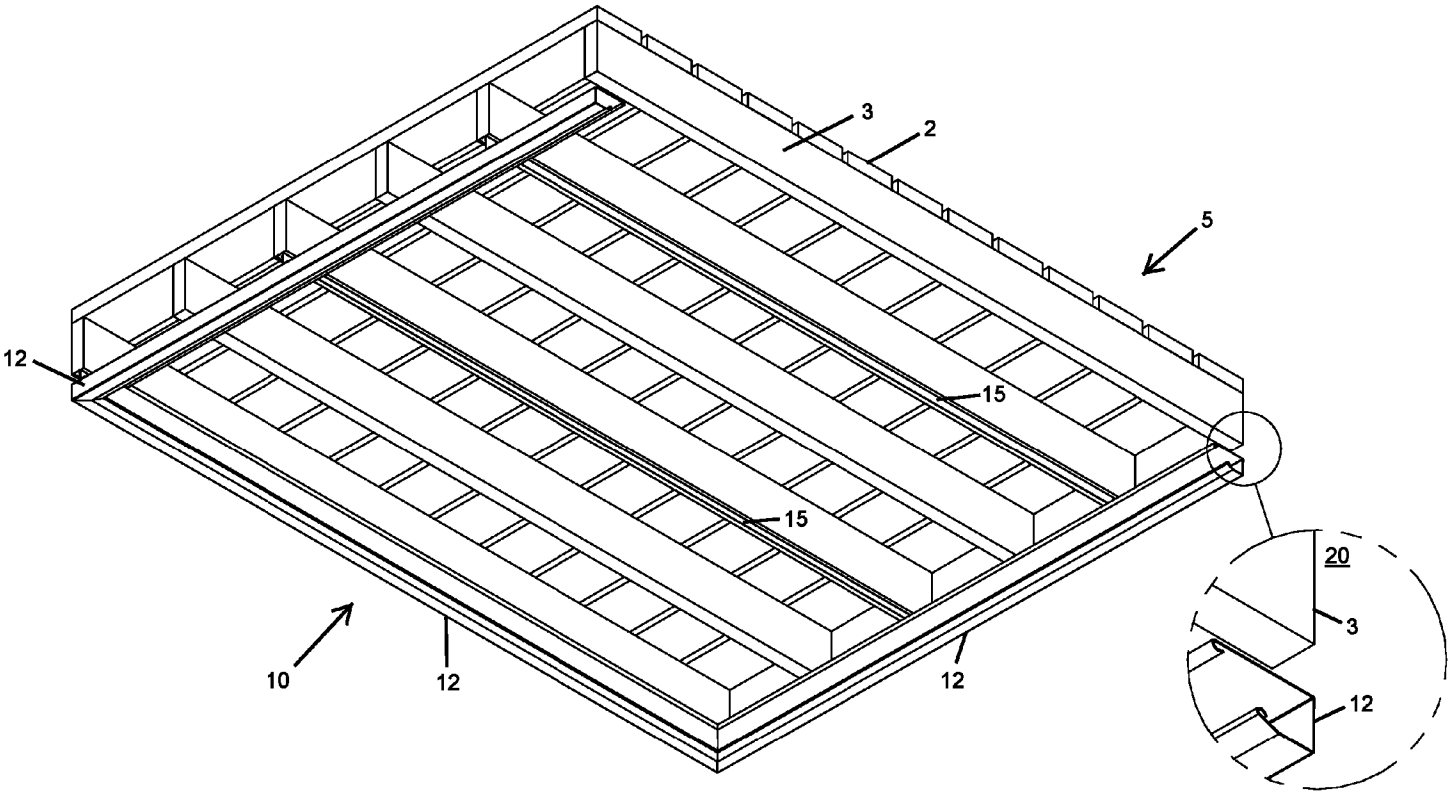
FIGS. 1A-1D are perspective views from beneath exemplary under-deck ceiling system installations further illustrating a process of installation.
Figure 1B:
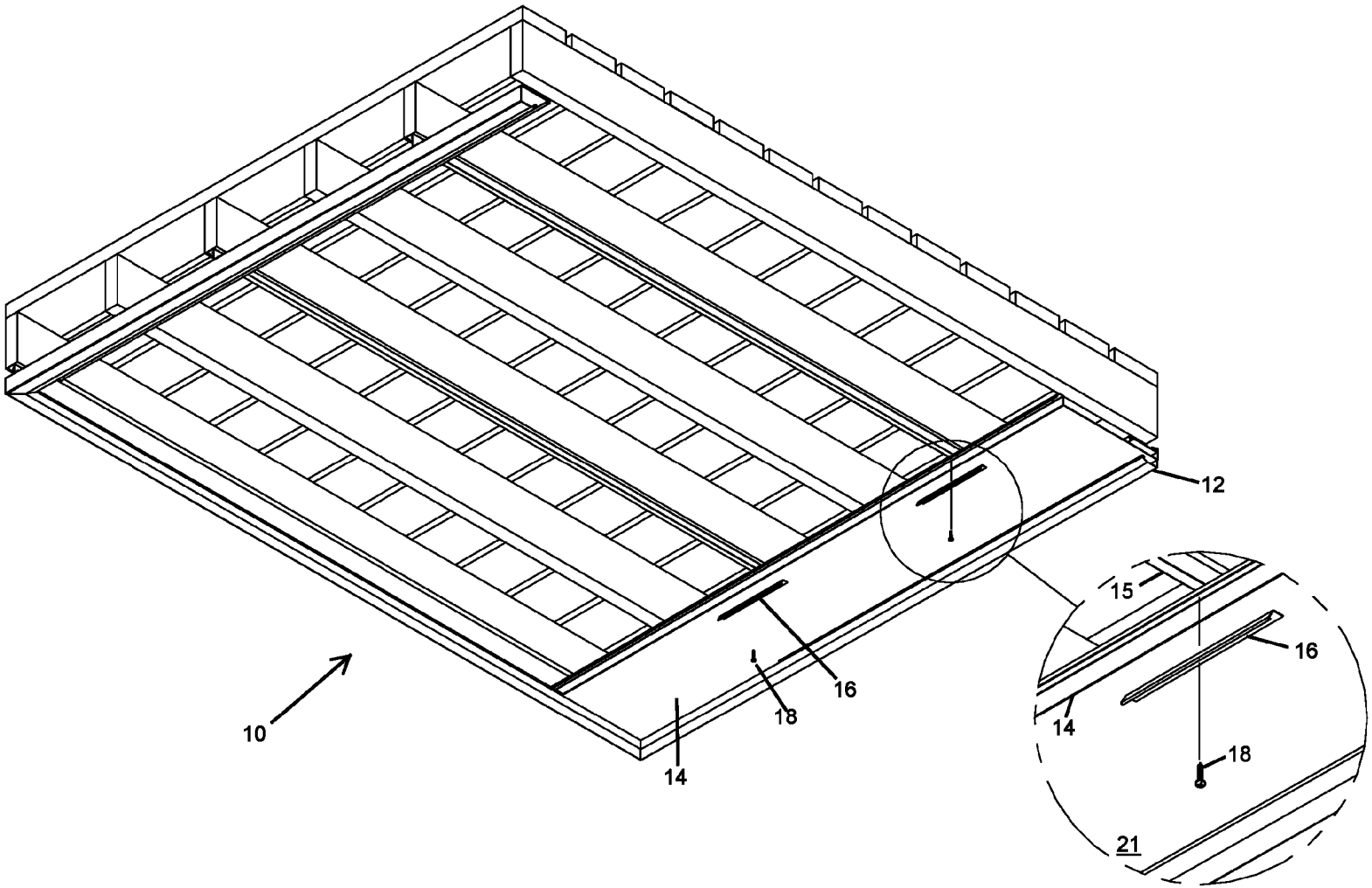
Figure 1C:
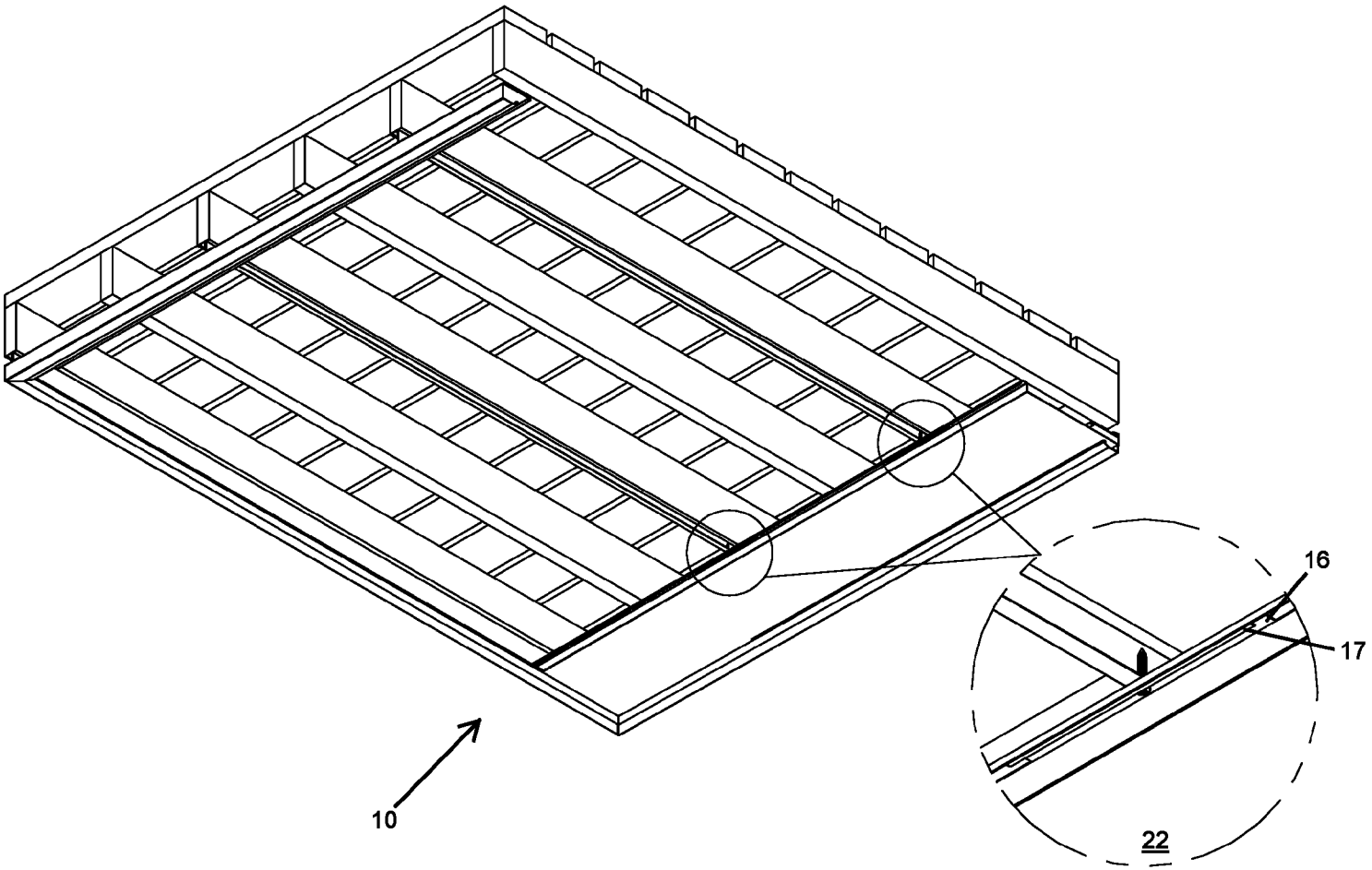
Figure 1D:
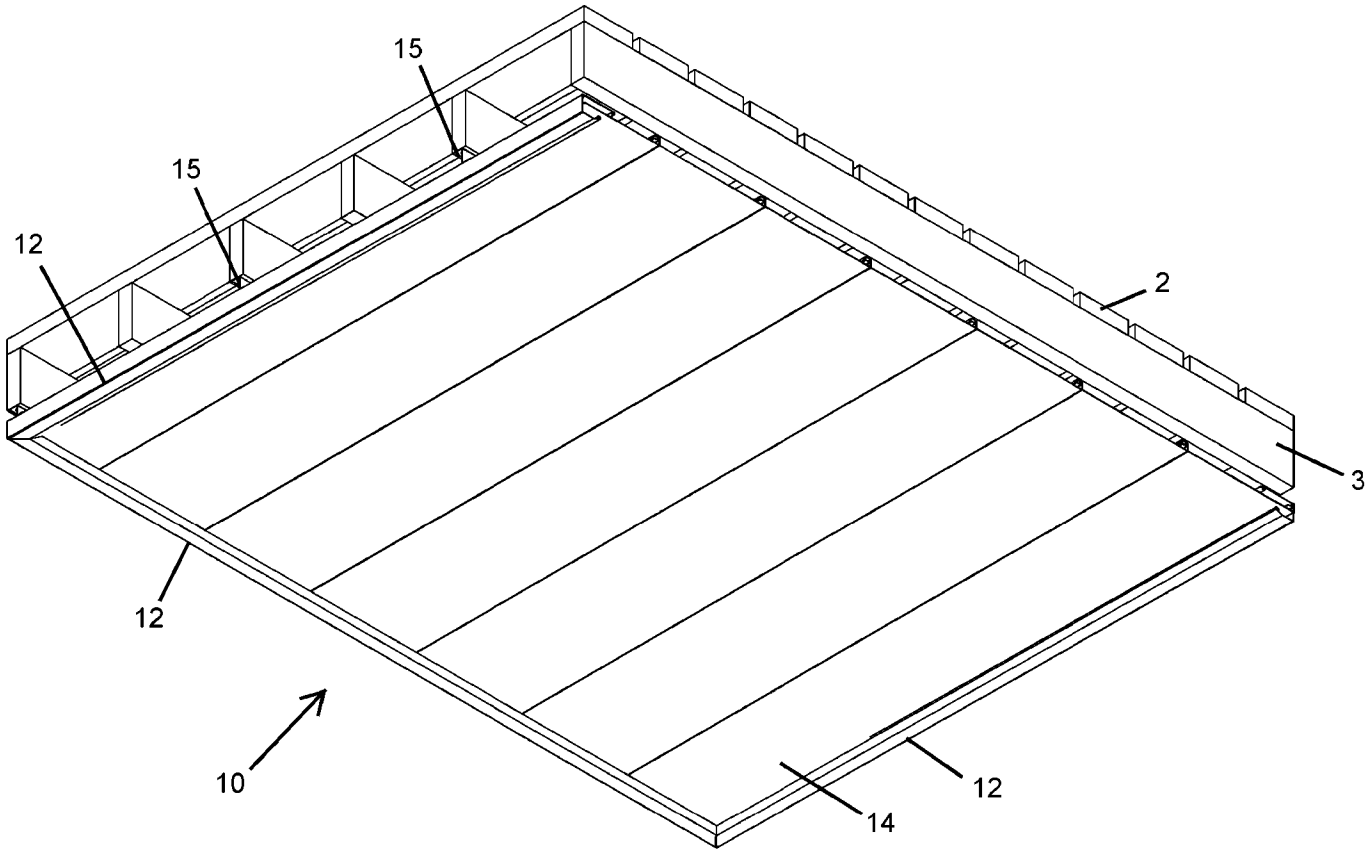
Figure 2:
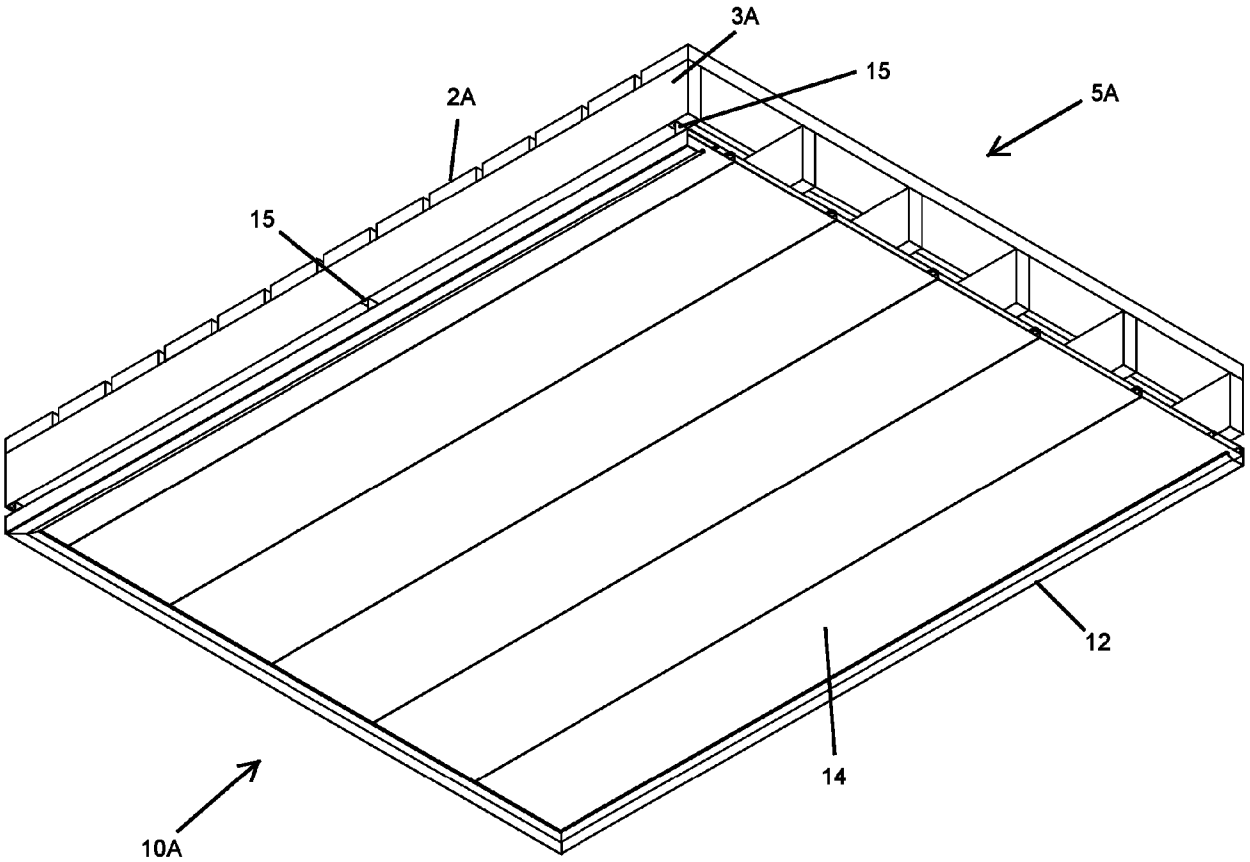
FIG. 2 is a perspective view from beneath another exemplary under-deck ceiling system after installation.

Referring now to FIGS. 1A-1D, an example of a panelized ceiling system 10 is shown, along with a process of installation. Ceiling system 10 is suitable for installation on any type of ceiling structure that may be exposed to the elements, i.e., sun, wind, rain and temperature variations. Examples of such installation locations are porches, decks, over-hanging roofs and the like. Generally, structures supporting porches, decks, over-hanging roofs and the like include joists (or beams) 3 that are positioned in a parallel horizontal arrangement to provide the structural support to an associated top structure such as decking planks 2. In the embodiment depicted in FIGS. 1A-1D, panels 14 of ceiling system 10 are installed parallel to joists 3 of a deck 5, but panels 14 may alternatively be installed perpendicular to joists, as shown in FIG. 2. At the start of construction, as shown in FIG. 1A, a number of suspension rails 15 are fastened, e.g., with screws or nails, to the bottoms of at least some of joists 3, which in the illustrated example is an arrangement with suspension rails 15 parallel to joists 3, with a suspension rail 15 secured under every other joist 3. Suspension rails 15 permit installation under a deck without requiring a specific on-center deck joist spacing, and allow for positioning of the gutter ends of panels 14 in a direction away from the structure to which the deck is attached. Suspension rails 15 are provided with different heights, e.g., 1", 1.25", 1.5", 1.75", 2", and so forth, providing a controlled downward slope of ceiling system 10 away from the structure to which the deck is attached. Three end channels 12 are installed around the periphery of ceiling system 10, which will support the ends of panels 14 and an initial side of a first panel 14 to be installed. End channels 12 can be fastened to suspension rails 15, or can be fastened to other framing members added to the deck, and the backmost end channel 12 may be fastened to the structure to which the deck is attached. The ends of end channels 12 that are joined at the back of the deck are matched with 45 degree cuts and may be sealed with sealant, although such connection is not required. The front open side of the U-shaped frame provided by end channels 12 provides for the ends of panels 14 to drain into a gutter (not shown), which can be provided below the ends of panels 14 and framed in to hide the gutter. A detail view 20 shows an end of an end channel 12, which will also generally drain into a gutter.

After end channels 12 and suspension rails 15 are installed as shown in FIG. 1A, installation of panels 14 commences. An initial panel 14 is installed as shown in FIG. 1B with a second long side of panel 14 inserted in end channel 12 as shown. Panels 14 may be cut to provide distribution of any width of the ceiling system 10 that exceeds a multiple of the width of panels 14 to be distributed at each side of ceiling system 10 or installation may commence with a full panel 14 as shown. After the second long side of panel 14 is inserted in end channel 12, the first long side of panel 14 is fastened to suspension rails 15 with screws 18. In addition to securing panel 14, a set of retaining clips 16 is installed along the first long side of panel 14, generally at each suspension rail 15, as shown in the process of installation in detail 21 of FIG. 1B and as installed in detail 22 of FIG. 1C. Retaining clips 16 have a hook-shaped edge 17, which is used to capture the second long side of the second panel 14, which is then fastened along a second long side of second panel 14 in the same manner as the first panel 14 was installed, i.e., screws 18 are used to fasten the second long side of panel 14 and install additional retaining clips 16 for installation of the next panel 14. Installation proceeds as described above for remaining panels 14, until the last panel 14 is installed as shown in FIG. 1D, with the first long side of the last panel 14 inserted into end channel 12, which as illustrated is an edge that has been cut to fit, and the second edge of panel 14 is forced upward to "snap" the last panel 14 into place within the retaining clips 16 that were installed along the first long side of the next-to-last panel 14.

FIG. 2 shows an alternative arrangement of a ceiling panel system 10A, installed under a deck 5A having joists 3A and decking planks 2A running in directions perpendicular to the arrangement of joists 3 and decking planks 2, respectively, of the deck shown in FIGS. 1A-1D. Other than mounting suspension rails perpendicular to joists 3A and mounting the two parallel end channels 12 along joists 3A rather than perpendicular to joists 3, installation of ceiling system 10A proceeds as described above with respect to FIGS. 1A-1D. When installation is complete, ceiling systems 10 and 10A provides channels formed by panels 14 and also end channels 12 that drain condensation or rainwater away from beneath the structure under which ceiling systems 10 and 10A are installed. Further, when fully installed, ceiling systems 10, 10A provide a smooth outer surface when viewed from below that may be covered with any type of finish. Examples of finishes are paint, epoxy, anodized coatings or any other decorative or protective covering.

Figure 3:
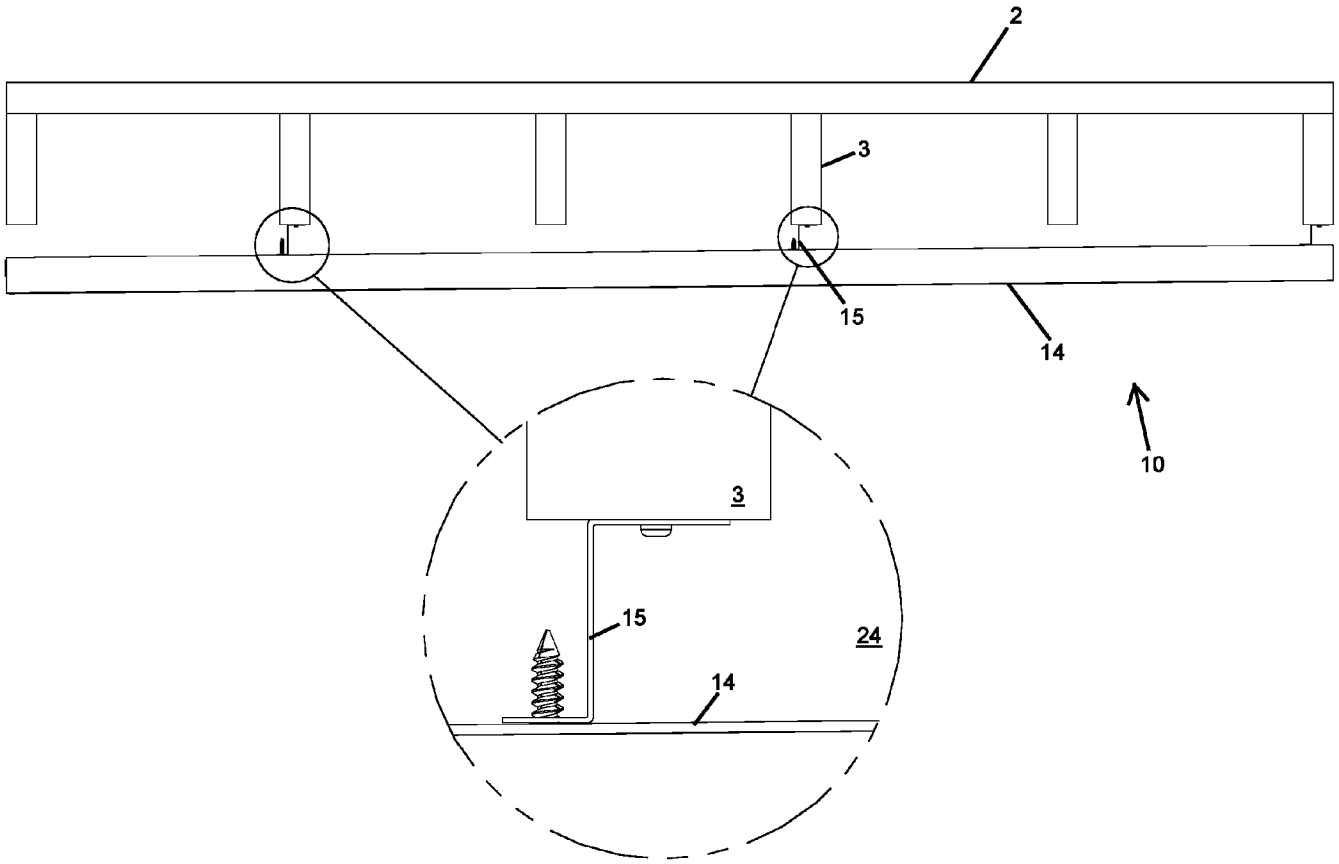
FIG. 3 is an end view of the exemplary ceiling system installation of FIGS. 1A-1D.

FIG. 3 shows a detail 24 of the connections between suspension rails 15, joists 3 and panels 14 in ceiling panel system 10 of FIGS. 1A-1D, in which the first long side of each of panels 14 is fastened across each of suspension rails 15. FIG. 3 also illustrates the slope of ceiling panel system 10, which is downward toward the left of the Figure, since the height of the individual suspension rails 15 increases in the leftward succession of suspension rails 15.

Figure 4:
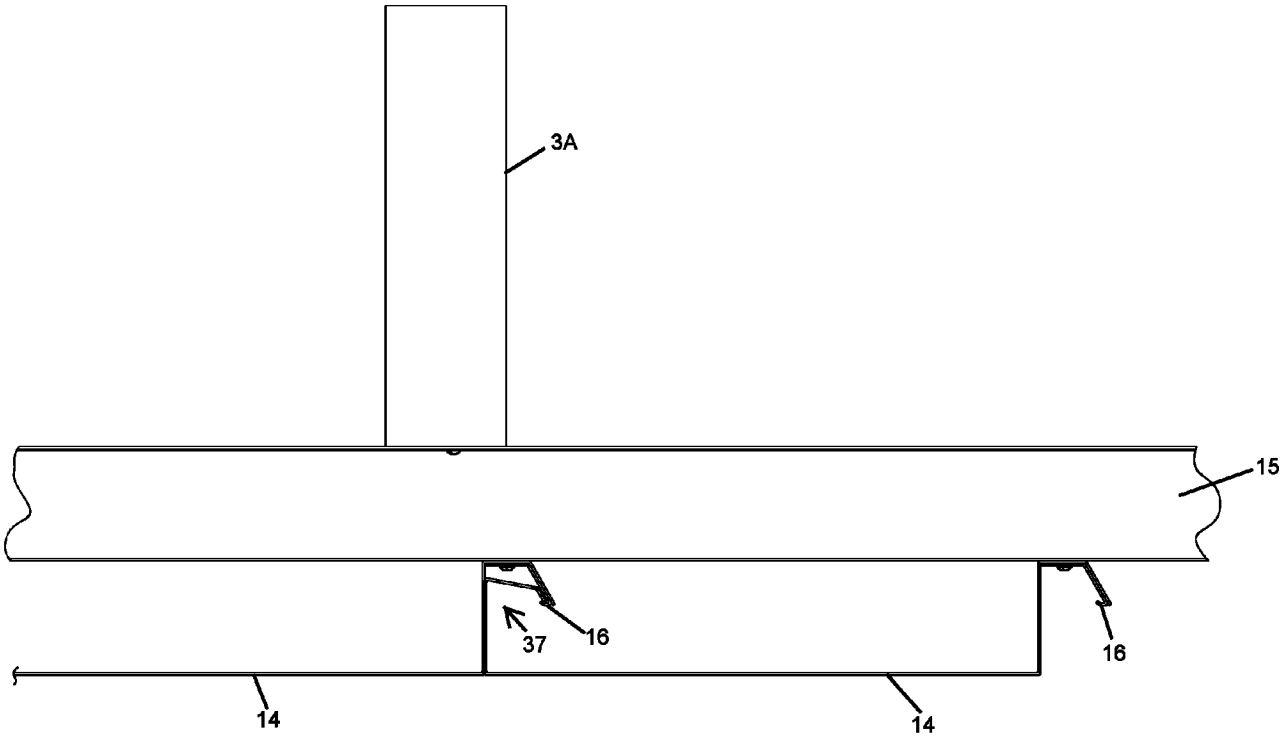
FIG. 4 is a detailed view of an end view of the exemplary ceiling system installation of FIG. 2.

FIG. 4 shows a detail of the connections between suspension rails 15, joists 3A and panels 14 in ceiling panel system 10A of FIG. 2, in which the second long edge of each of panels 14 is fastened to a suspension rail 15 secured underneath joists 3A at locations where suspension rail 15 crosses joists 3A. Also illustrated are retaining clips 16, and in particular the capture of a second bracket 37 of a panel 14 by a hook-shaped end of retaining clip 16.

Figure 5:
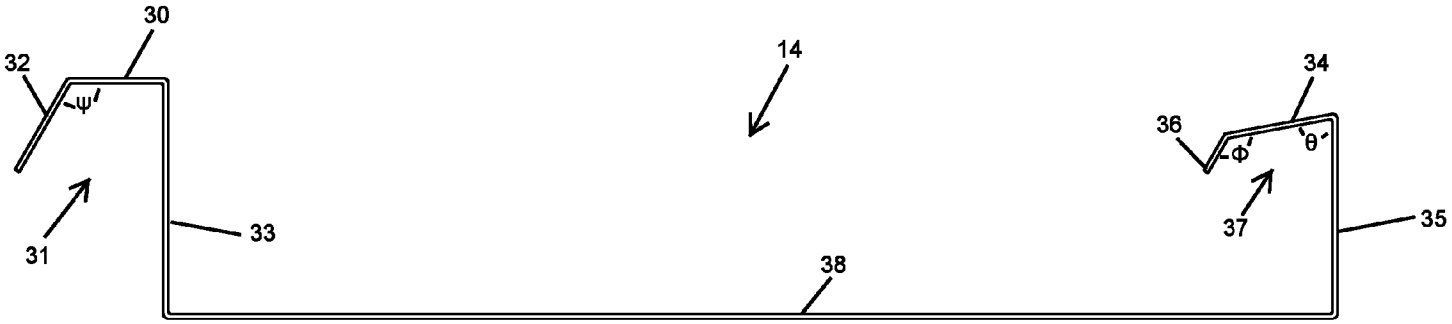
FIG. 5 is an end view of an exemplary ceiling panel as installed in the ceiling panel systems shown in FIGS. 1A-1D and FIG. 2.
Figure 6:
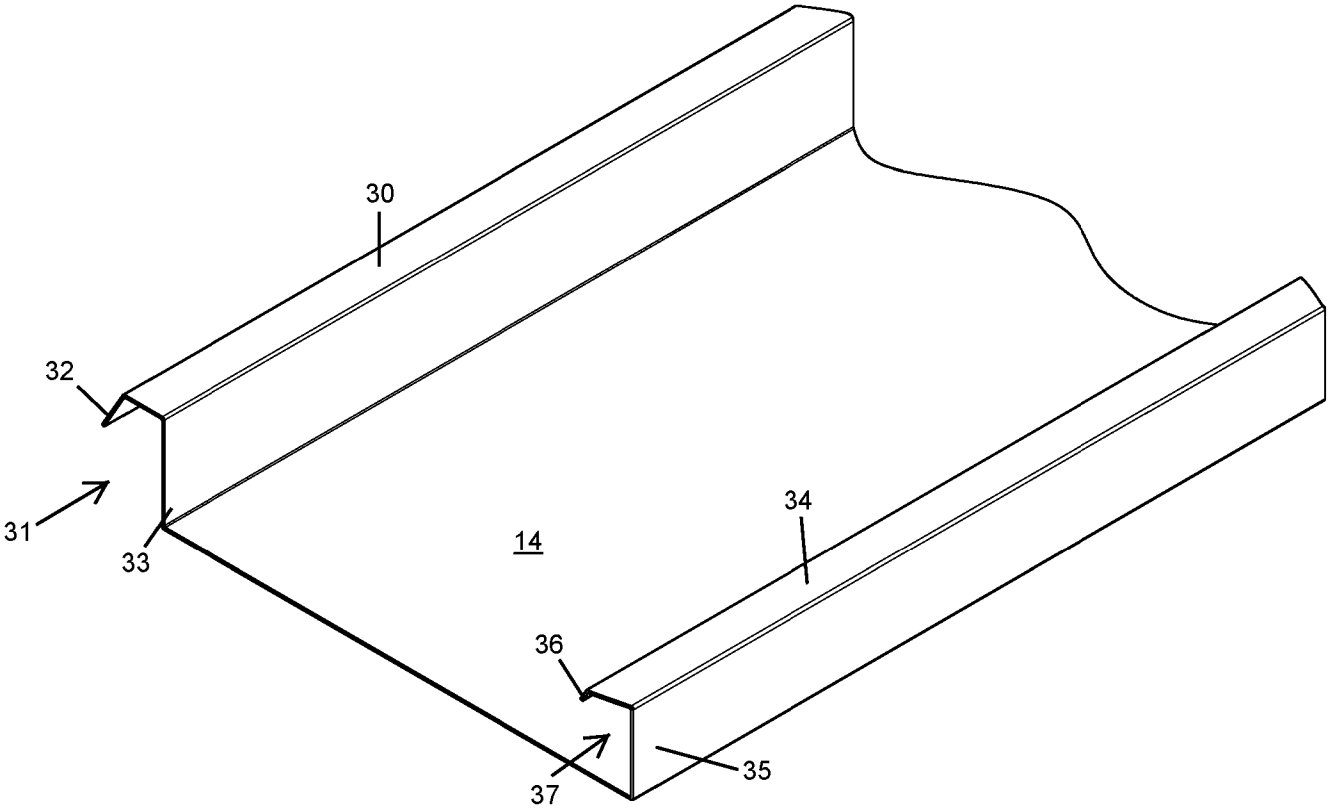
FIG. 6 is a perspective view of the exemplary ceiling panel of FIG. 5.

Referring now to FIG. 5 and FIG. 6, details of panels 14 are shown, including a first bracket 31 formed on the first long side of panel 14 and second bracket 37 formed on the second long side of panel 14 between a ceiling portion 38 of panel 14. Second bracket 37 has a top portion 34 that extends at a first acute angle θ from a vertical wall 35 forming a second long side of panel 14 and a flange portion 36 that extends from top portion 34 at a first oblique angle Φ and provides for alignment of panels 14 installed subsequent to the initial panel 14. Second bracket 37 of an initial panel 14 is inserted in one of end channels 12 as described above with reference to FIG. 1A. First bracket 31 has a horizontal top portion 30 that extends from a vertical wall 33 forming a first long side of panel 14 and a flange portion 32 that extends at another oblique angle ψ from horizontal top portion 34, which is generally Φ-90 degrees-θ, so that flange portion 32 is parallel to flange portion 36 when installing panels 14 so that flange portion 36 of a subsequent panel lies against flange portion 32 of a previous panel.

Figure 7A:
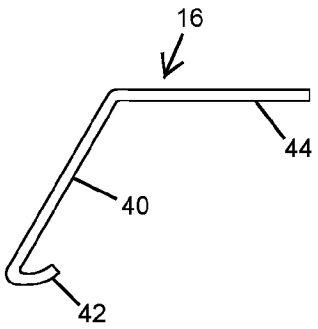
FIG. 7A is an end view of, and FIG. 7B is a perspective view of, an exemplary retaining clip as installed in the ceiling panel systems shown in FIGS. 1A-1D and FIG. 2.
Figure 7B:
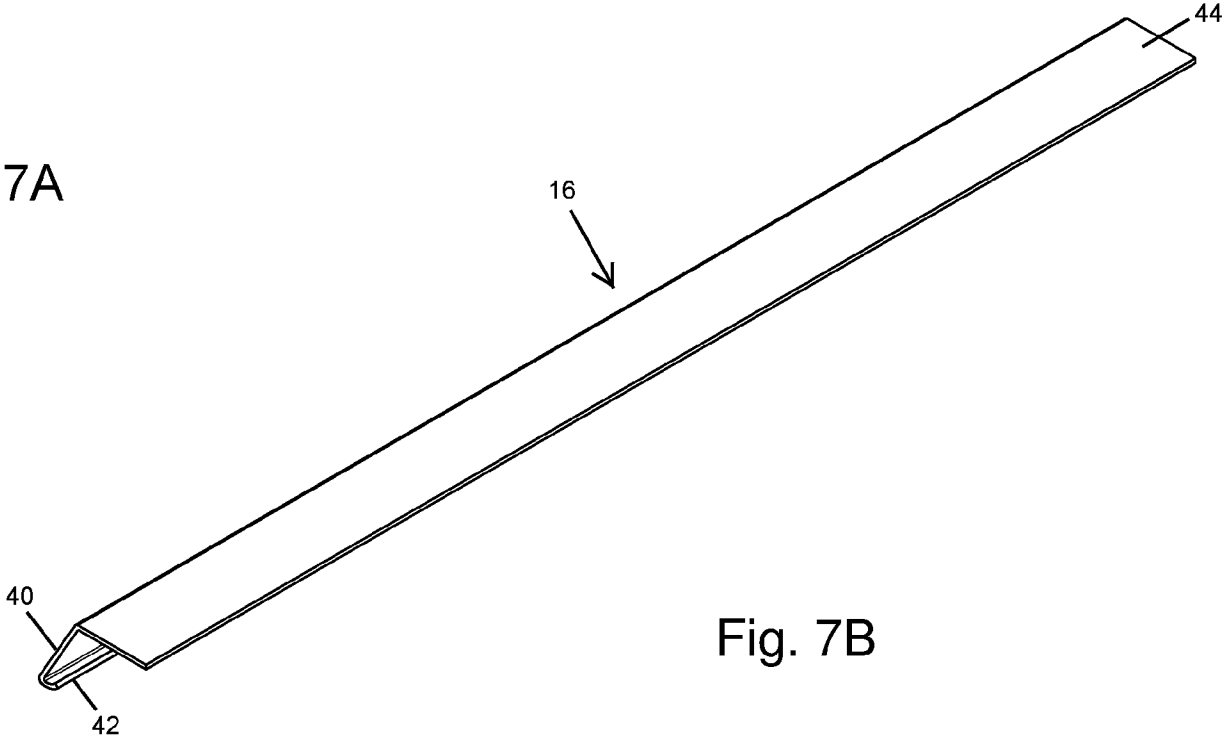

Referring now to FIG. 7A and FIG. 7B, details of retaining clips 16 are shown. A length of retaining clips 16 is approximately 8 inches or less. Retaining clips 16 include a top edge 44 from which a flange portion 40 extends at oblique angle ψ, so that when retaining clips 16 are fastened along top portion 30 and flange portion 32 of the first bracket 31 of a ceiling panel, flange portion 32 and flange portion 40 lie flush together. An inward extension 42 projects from a lower end of flange portion 40, providing the hook-shaped edge mentioned above, that provides for snapping second bracket 37 of a panel being installed into the existing assembly of first bracket 31 and retaining clips 16 that are installed intermittently along the first bracket 31. Since retaining clips 16 only represent a portion of the length of the panel system, the use of retaining clips facilitates the insertion of second bracket 37 into first bracket 31 of another panel. In the instant example, with retaining clips 16 installed at a 24-inch spacing and having an 8-inch length, only 25% of the edges of panels 14 engage with retaining clips 16, permitting the other 75% of the length of panels 14 between retaining clips 16 to flex to some degree, easing installation of panels 14.

Figure 8A:
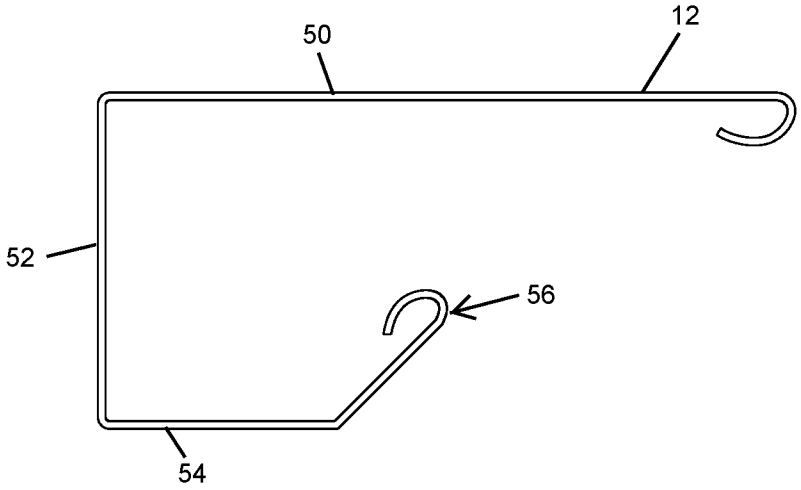
FIG. 8A is an end view of, and FIG. 8B is a perspective view of, an exemplary end channel as installed in the ceiling panel systems shown in FIGS. 1A-1D and FIG. 2.
Figure 8B:
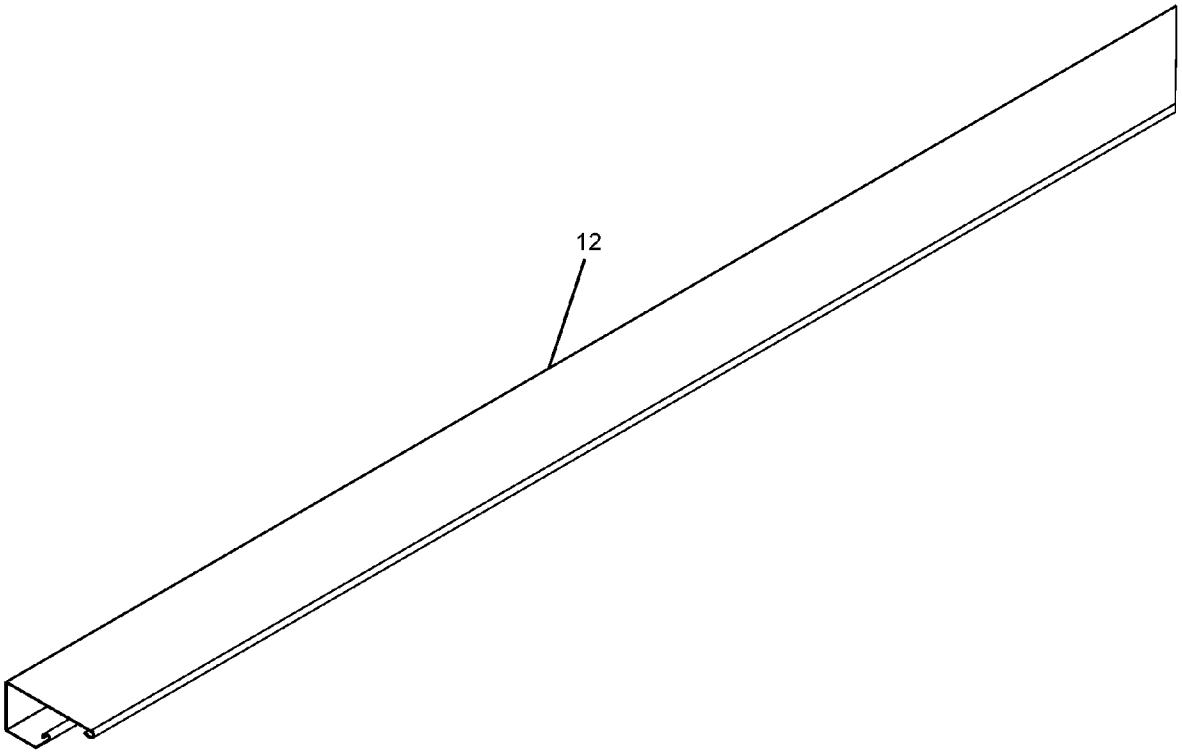

Referring now to FIG. 8A and FIG. 8B, details of end channels 12 are shown. End channels 12 have a top portion 50, which can be used to secure end channels to suspension rails 15 and a vertical wall 52, which can be used to secure end channels to the deck frame and/or building structure. Either or both attachment techniques can be used. For example, at the building end of the deck, use of a suspension rail may be omitted, and the first end channel 12 mounted to the underside of the first joist and alternatively, or in combination, fastened to the building structure, i.e., the first suspension rail 15 may be located away from the building and have a lower height than in the above examples, such as ½". A bottom face 54 of end channel 12 and an extending flange 56 provide support and concealment of the ends of panels 14 providing both aesthetic function and also drainage for any water that enters end channel 12. The gap between extending flange 56 and top portion 50 is less than the height of panel 14, i.e., the height of first and second brackets 31 and 37, so that extending flange 56 will distend when inserting ceiling panels 14 and provides secure fit without undesirable gaps.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A ceiling panel system installable to supporting beams from beneath, comprising:

a plurality of ceiling panels, the ceiling panels having a ceiling portion including a top surface, a first bracket formed along a first long side of the ceiling portion, including a first vertical wall extending upward at a right angle from the top surface of the ceiling portion, a first top portion extending from the first vertical wall at a right angle, and a first outwardly extending flange extending outward and downward from the first top portion at a first oblique angle, the ceiling panels further including a second bracket formed along a second long side of the ceiling portion opposite the first long side, the second bracket including a second vertical wall extending at a right angle to the top surface of the ceiling portion, an inwardly extending flange extending from the second vertical wall at an acute angle, and an outwardly extending member formed at a side of the inwardly extending flange opposite the second vertical wall and extending from the inwardly extending flange at a second oblique angle; and a plurality of retaining clips for installation at intervals along a length of the ceiling panels, the retaining clips including a retaining clip top portion and a retaining clip flange portion extending from the retaining clip top portion at the first oblique angle for placement along, respectively, the first top portion and the first outwardly extending flange of a first bracket of a corresponding one of the plurality of ceiling panels, the retaining clips further including an inwardly extending member extending from a lower portion of the retaining clip flange portion at an acute angle, so that when a second bracket of one of the ceiling panels is fitted within a first bracket of another one of the ceiling panels to which a number of the retaining clips have been installed along the length thereof, the second bracket of the one of the ceiling panels is captured by the inwardly extending members of the number of retaining clips.

2. The ceiling panel system of claim 1, further comprising a plurality of suspension rails for attaching the ceiling panels and retaining clips to deck joists, wherein the suspension rails have a top face and a bottom face, a separation distance between which changes along the lengths of the suspension rails.

3. The ceiling panel system of claim 2, wherein the supporting beams are a plurality of deck joists arranged under a plurality of decking planks fastened thereto and extending in a direction perpendicular to the desk joists, wherein the top faces of the plurality of suspension rails are fastened along lengths of the plurality of deck joists by fasteners, and wherein the ceiling panels and retaining clips are fastened via other fasteners to bottom faces of the suspension rails.

4. The ceiling panel system of claim 2, wherein the supporting beams are a plurality of deck joists arranged under a plurality of decking planks fastened thereto and extending in a direction perpendicular to the desk joists, wherein the top faces of the plurality of suspension rails are fastened to the plurality of deck joists by fasteners and are arranged in a direction perpendicular to the lengths of the plurality of deck joists, and wherein the ceiling panels and retaining clips are fastened via other fasteners to bottom faces of the suspension rails.

5. The ceiling panel system of claim 1, wherein the acute angle is less than 180 degrees (180°) minus the first oblique angle.

6. The ceiling panel system of claim 1, wherein a length of the retaining clips is such that a length of the gaps between the retaining clips along the length of the ceiling panels is greater than or equal to 50% of the length of the retaining clips.

7. The ceiling panel system of claim 1, wherein a length of the retaining clips is 8 inches or less.

8. A method of providing a ceiling system under a deck formed from a plurality of deck joists arranged in a parallel configuration, above which are fastened a plurality of deck planks perpendicular thereto, the method comprising:

installing a first ceiling panel having a ceiling portion including a top surface, a first bracket formed along a first long side of the ceiling portion, including a first vertical wall extending upward at a right angle from the top surface of the ceiling portion, a first top portion extending from the first vertical wall at a right angle, and a first outwardly extending flange extending outward and downward from the first top portion at a first oblique angle, the ceiling panels further including a second bracket formed along a second long side of the ceiling portion opposite the first long side, the second bracket including a second vertical wall extending at a right angle to the top surface of the ceiling portion, an inwardly extending flange extending from the second vertical wall at an acute angle, and an outwardly extending member formed at a side of the inwardly extending flange opposite the second vertical wall and extending from the inwardly extending flange at a second oblique angle;

second installing a plurality of retaining clips at intervals along a length of the ceiling panel, the retaining clips including a retaining clip top portion and a retaining clip flange portion extending from the retaining clip top portion at the first oblique angle, the retaining clips further including an inwardly extending member extending from a lower portion of the retaining clip flange portion at an acute angle;

third installing a second ceiling panel identical to the first ceiling panel by fitting the second bracket of the second ceiling panel within the first bracket of the first ceiling panel and the retaining clips so that the second bracket of second ceiling panel is captured by the inwardly extending members of the number of retaining clips; and repeating the second and third installing for a number of subsequent pluralities of retaining clips and subsequent ceiling panels.

9. The method of claim 8, further comprising prior to the first installing, the second installing and the third installing, installing a plurality of suspension rails for attaching the ceiling panels and retaining clips to deck joists, wherein the suspension rails have a top face and a bottom face, a separation distance between which changes along the lengths of the suspension rails, and wherein the first installing, the second installing and the third installing fasten the ceiling panels and the retaining clips to the suspension rails.

10. The method of claim 9, wherein the top faces of the plurality of suspension rails are fastened along lengths of the plurality of deck joists by fasteners, and wherein the ceiling panels and retaining clips are fastened via other fasteners to bottom faces of the suspension rails.

11. The method of claim 9, wherein the top faces of the plurality of suspension rails are fastened to the plurality of deck joists by fasteners and are arranged in a direction perpendicular to the lengths of the plurality of deck joists, and wherein the ceiling panels and retaining clips are fastened via other fasteners to bottom faces of the suspension rails.

12. The method of claim 8, wherein a length of the retaining clips is such that a length of the gaps between the retaining clips along the length of the ceiling panels is greater than or equal to 50% of the length of the retaining clips.

13. The method of claim 9, wherein a length of the retaining clips is 8 inches or less.

14. A method of manufacturing a ceiling panel system installable to supporting beams from beneath, comprising:

first forming a plurality of ceiling panels, the ceiling panels having a ceiling portion including a top surface, a first bracket formed along a first long side of the ceiling portion, including a first vertical wall extending upward at a right angle from the top surface of the ceiling portion, a first top portion extending from the first vertical wall at a right angle, and a first outwardly extending flange extending outward and downward from the first top portion at a first oblique angle, the ceiling panels further including a second bracket formed along a second long side of the ceiling portion opposite the first long side, the second bracket including a second vertical wall extending at a right angle to the top surface of the ceiling portion, an inwardly extending flange extending from the second vertical wall at an acute angle, and an outwardly extending member formed at a side of the inwardly extending flange opposite the second vertical wall and extending from the inwardly extending flange at a second oblique angle; and second forming a plurality of retaining clips for installation at intervals along a length of the ceiling panels, the retaining clips including a retaining clip top portion and a retaining clip flange portion extending from the retaining clip top portion at the first oblique angle for placement along, respectively, the first top portion and the first outwardly extending flange of a first bracket of a corresponding one of the plurality of ceiling panels, the retaining clips further including an inwardly extending member extending from a lower portion of the retaining clip flange portion at an acute angle, so that when a second bracket of one of the ceiling panels is fitted within a first bracket of another one of the ceiling panels to which a number of the retaining clips have been installed along the length thereof, the second bracket of the one of the ceiling panels is captured by the inwardly extending members of the number of retaining clips.

15. The method of claim 14, wherein the first forming is performed by rolling metal sheet stock through a tool having directing members for bending the sheet stock to form the top surface, the first bracket and the second bracket at the sides of the ceiling panels.

16. The method of claim 14, wherein the first forming is performed by molding a plastic material to form the top surface, the first bracket and the second bracket at the sides of the ceiling panels.

17. The method of claim 14, wherein the retaining clips are formed by rolling metal stock through a tool having directing members for bending the metal stock.

18. The method of claim 14, wherein a length of the retaining clips is such that a length of the gaps between the retaining clips along the length of the ceiling panels when the retaining clips are installed is greater than or equal to 50% of the length of the retaining clips.

19. The method of claim 14, wherein a length of the retaining clips is 8 inches or less.

* * * * *